US005664943A

United States Patent [19]

Joos et al.

[11] Patent Number: 5,664,943

[45] Date of Patent: Sep. 9, 1997

[54] METHOD AND DEVICE FOR OPERATING A COMBINED BURNER FOR LIQUID AND GASEOUS FUELS

[75] Inventors: Franz Joos, Weilheim; Tino-Martin Marling, Uehlingen-Birkendorf, both of Germany; Peter Senior, Stoney Stanton, Great Britain

[73] Assignee: ABB Research Ltd., Zurich, Switzerland

[21] Appl. No.: 450,696

[22] Filed: May 25, 1995

[30] Foreign Application Priority Data

Jul. 13, 1994 [DE] Germany ..... 44 24 599.8

[51] Int. Cl.[6] ..... F23C 5/00

[52] U.S. Cl. ..... 431/8; 431/9; 431/284; 431/285; 431/351; 60/737; 60/746; 60/747

[58] Field of Search ..... 431/9, 284, 285, 431/351, 8; 60/737, 746, 747

[56] References Cited

U.S. PATENT DOCUMENTS

| | | | |
|---|---|---|---|
| 4,976,607 | 12/1990 | Grimard | 431/284 |
| 5,244,380 | 9/1993 | Dobbeling et al. | 431/284 |
| 5,451,160 | 9/1995 | Becker | 431/284 |

FOREIGN PATENT DOCUMENTS

| | | |
|---|---|---|
| 0321809 | 6/1989 | European Pat. Off. . |
| 0594127A1 | 4/1994 | European Pat. Off. . |
| 3826279A1 | 2/1989 | Germany . |
| 3913124A1 | 12/1989 | Germany . |
| 4304201A1 | 8/1994 | Germany . |
| 4306956A1 | 9/1994 | Germany . |
| 2091409 | 7/1982 | United Kingdom . |
| WO94/00717 | 1/1994 | WIPO . |

*Primary Examiner*—Carroll B. Dority

*Attorney, Agent, or Firm*—Burns, Doane, Swecker & Mathis, L.L.P.

[57] ABSTRACT

A method and device for operating a combined burner for liquid and gaseous fuels for the purpose of generating hot gases functions to raise the lean stability limit of the gas flame without impairing the atomization of the liquid fuel and improve the regulating range of the burner. According to the invention, this is achieved when the inflow rate and/or swirl of the blast air (5) into the inner burner space (16) is controlled. To this end, the blast air (5), during operation with gaseous fuel (6), is throttled back by injection of pilot fuel into the blast air, and additionally swirled by swirl generators in the burner. In addition, active regulation of the blast air inflow rate is effected at the burner inlet during the use of both gaseous fuel and liquid fuel.

21 Claims, 7 Drawing Sheets

METHOD AND DEVICE FOR OPERATING A COMBINED BURNER FOR LIQUID AND GASEOUS FUELS

BACKGROUND OF THE INVENTION

1. Field of the Invention

The invention relates to a method and a device for operating a combined burner for liquid and gaseous fuels for the purpose of generating hot gases.

2. Discussion of Background

To achieve the lowest possible NOx emissions, burners are operated close to their lean extinguishing limit. This results in the disadvantage that the regulating range of the burners is greatly restricted. In order to remove this disadvantage, individual burners are switched off during partial load of the gas turbine so that the remaining burners can be operated in their stability range. But this is accompanied by an impairment in the temperature distribution over the periphery.

A further possibility of improving the regulating range of the burner is to enrich the fuel gases with additional fuel near the axis of the burner, which is also called internal piloting. As a result, the stability range of the burners is extended by the injection of a pilot gas to such an extent that reliable operation is guaranteed. To alternatively operate a burner with gas or fuel oil, a method is known in which the fuel oil used as an alternative to the pilot gas is atomized by means of an airblast nozzle. In this method, air is injected to atomize the fuel oil near the axis, i.e. in the center of the burner. But this is done not only during the fuel-oil atomization but also during pilot operation with gas, in which, however, no blast air is required for the atomization. This additional air destabilizes the pilot-gas flame on the one hand by making the mixture leaner and on the other hand by the oncoming air flow itself. The destabilizing leads to a clear reduction in the lean extinguishing limit of the gas flame.

SUMMARY OF THE INVENTION

Accordingly, one object of the invention, in attempting to avoid these disadvantages, is to provide a method and a device for operating a combined burner for liquid and gaseous fuels for the purpose of generating hot gases, which method and device raise the lean stability limit of the gas flame without impairing the atomization of the liquid fuel and improve the regulating range of the burner.

According to the invention, this is achieved when, in a method in which, the inflow of the blast air into the inner burner space is controlled. To this end, the blast air, during operation with gaseous fuel, is throttled back or throttled back and additionally swirled, or active regulation of its inflow is effected during the use of both gaseous fuel and liquid fuel.

The throttling-back is advantageously achieved by displacing the blast air by means of the pilot gas. For this purpose, the pilot-gas passage leads out in the air-feed line or in the outer and/or inner air passage so that the pilot gas is directed into the blast air inside the airblast nozzle or upstream in the area directly in front of it. The injection point lies sufficiently far from the air-inlet opening of the burner that the gaseous fuel cannot flow back into the plenum in front of the burner.

In this method, the pilot gas is injected to, the blast air at a higher pressure than the blast air. Therefore on the one hand it throttles the inflow of the blast air and on the other hand is at least partly mixed with this air before entering the inner burner space. The throttling of the air feed leads to the desired enrichment of the fuel gases and the early mixing of the pilot gas with the blast air for reducing the oncoming flow of the gas flame. Stabilization of the flame and an improvement in the lean extinguishing limit are thereby achieved during pilot-gas operation without having to dispense with the possibility of the advantageous fuel-oil atomization by means of an airblast nozzle.

It is especially convenient when a jump in cross section of the burner wall is formed at the transition of the pilot-gas/air mixture from the airblast nozzle to the inner burner space. By the separation of the flow behind the jump in cross section, the pilot-gas/air mixture is kept at the burner axis and thus the lean extinguishing limit is further improved. The contour of the airblast nozzle at the atomization cross section remains unchanged and its function is not impaired.

In the method, in which the control of the inflow of the blast air into the inner burner space is effected by throttling-back and increased swirl, the pilot gas is injected into the outer air passage against the direction of flow of the blast air. By this type of injection, it is possible to largely throttle back the inflow of blast air, in particular its axial impulse, which is troublesome during operation of the burner with gaseous fuel. The injection of the pilot gas into the outer air passage takes place tangentially and either against or in the direction of rotation of the main burner air. As a result of the tangential injection of the pilot gas, a swirl is additionally imparted to the blast air. If this swirl is orientated in the opposite direction to the direction of rotation of the main burner air of the burner, increased friction and thus mixing of the two air flows occurs in the inner burner space. Thus the axial impulse of the blast air is weakened and the vortex breakdown, i.e. the breakdown of the fuel mixture, is upstream into the burner. On the other hand, if a swirl equidirectional to the direction of rotation of the main burner air is imparted to the blast air, this strengthens the vortex core of the fuel mixture in the burner axis so that the vortex breakdown is intensified and likewise displaced in the direction of the nozzle. In this way, the tangential injection of the pilot gas into the blast air, irrespective of the swirl direction, leads to an improvement in the flame maintenance and thus to stabilization of the combustion. The same effects can be achieved by introducing pilot gas already swirled beforehand into the blast air. To this end, at least one spacer is arranged between the burner wall and the intermediate wall of pilot-gas passage and outer air passage and is preferably of wound design. It serves to center the fuel-feed sleeve in the burner and in its preferred design produces the swirl of the fed pilot gas. As an alternative, the swirl can also be brought about by means of separately arranged swirl generators.

When the pilot-gas passage leads into the air-feed line upstream in the area in front of the airblast nozzle, the pilot gas is directed at this point into all the blast air and is mixed with it so that the pilot-gas/air mixture formed flows through both air passages of the airblast nozzle. This results in the additional advantage of increased throttling-back of the air and thus the further enrichment of the pilot-gas/air mixture provided for internal piloting. In addition, improved premixing of the pilot gas with the blast air occurs. Similar advantages can be achieved when the pilot gas is directed inside the airblast nozzle into both air passages. In this variant, however, the blast air can be throttled back to an even greater extent.

In another embodiment of the invention, the entry of the blast air into the inner burner space is actively regulated.

This is done by regulating the inflow of the blast air from the plenum into the burner during the use of both gaseous and liquid fuel. To this end, a drivable adjusting mechanism is arranged on the fuel lance or the burner connection piece, which adjusting mechanism at least partly closes the burner air-inlet opening for the blast air during operation of the burner with gaseous fuel. If the blast air is required only for the atomization of liquid fuel, the fuel pressure of the liquid fuel can advantageously be utilized to actuate the adjusting mechanism and thus to open the air-inlet openings of the burner. The pressure drop in the combustion chamber upon completion of the fuel feed then serves as counterpressure to the closing of the air-inlet openings. In addition to the advantages of the achievement according to the invention which have been described hitherto, it is possible in this embodiment to adapt the inflow of the blast air to the actual load state of the burner. For this purpose, the inflow of the blast air is regulated separately.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings of a plurality of exemplary embodiments of the invention illustrating various burners provided in each case with an airblast nozzle, wherein.

DESCRIPTION OF THE PREFERRED EMBODIMENTS

Figure 1:
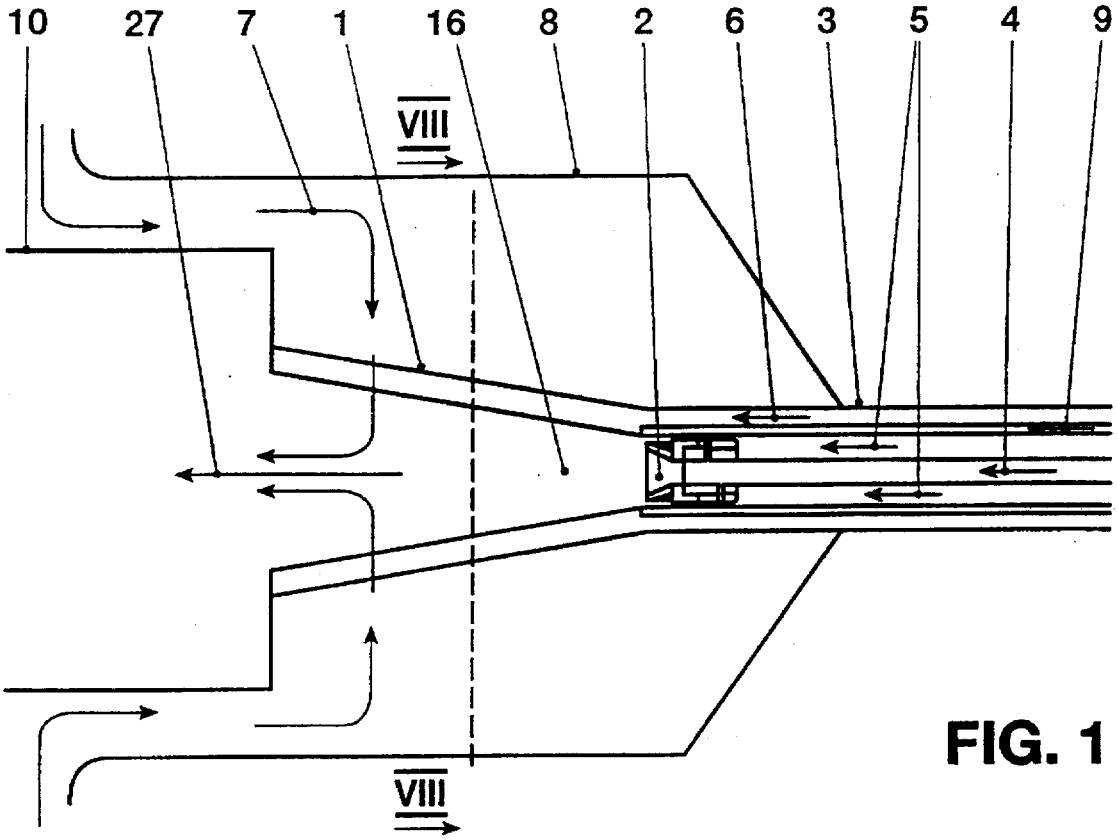
FIG. 1 shows a schematic representation of the arrangement of a burner equipped with an airblast nozzle.

Referring now to the drawings, wherein like reference numerals designate identical or corresponding parts throughout the several views, only the elements essential for understanding the invention are shown and the direction of flow of the working media is designated by arrows, an airblast nozzle 2 is arranged in the upstream end of a burner 1 designed as a double-cone burner 1. It is supplied with liquid fuel 4 and blast air 5 via a fuel lance 3 connected to the double-cone burner 1. In addition, the fuel lance 3 delivers the gaseous fuel 6 for the double-cone burner 1, which receives its main burner air 7 from the space inside the burner hood 8. The blast air 5 can also be fed directly from a plenum 34 located outside the burner hood 8. In addition, to enrich the fuel gases near the axis of the double-cone burner 1 via the fuel lance 3, gaseous fuel, so-called pilot gas 9, is additionally injected into the burner 1. This pilot gas 9 flows into the burner chamber 10 downstream (FIG. 1).

Figure 2:
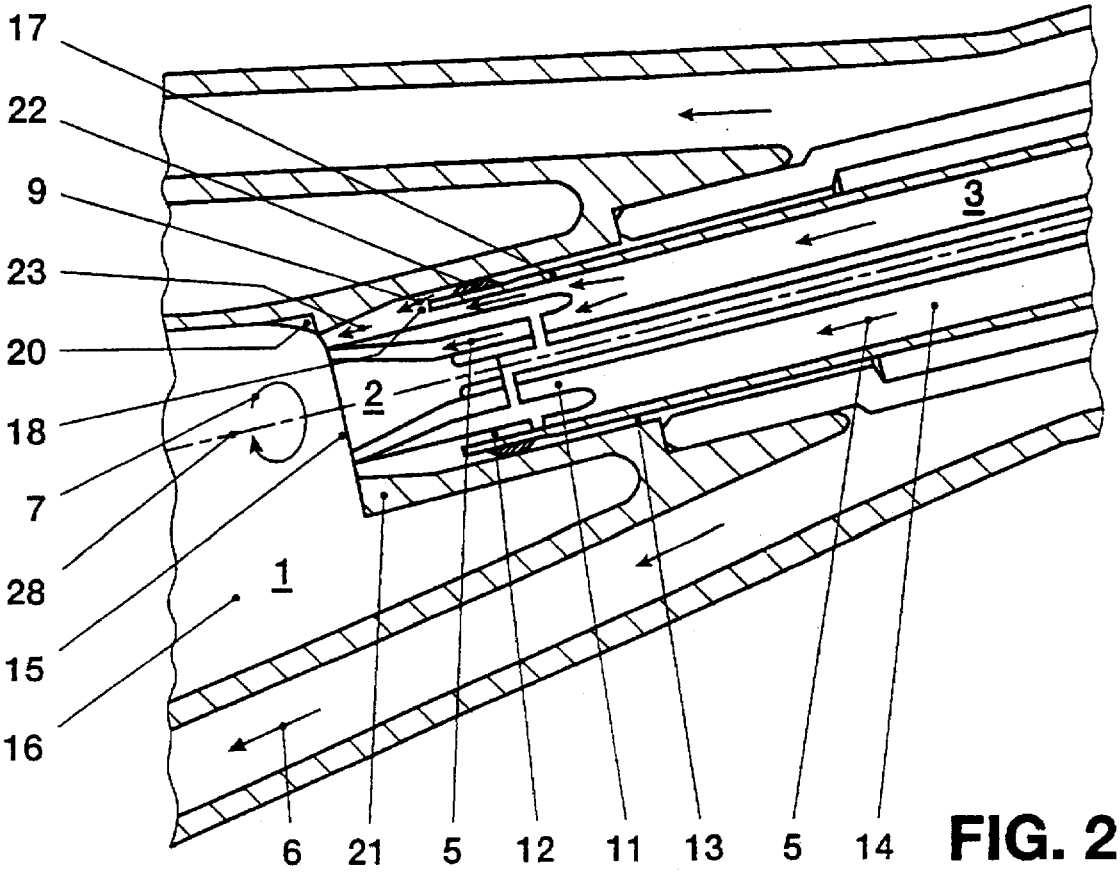
FIG. 2 shows a partial longitudinal section of the burner FIG. 1.

The airblast nozzle 2 has an inner air passage 11 and an outer air passage 12. A pilot-gas passage 13 is arranged concentrically outward of the inner air passage 11 and outer air passage 12. The two air passages 11, 12 are connected upstream to an air-feed line 14 and lead into the inner burner space 16 at the atomization cross section 15 of the airblast nozzle 2. The air-feed line 14 and the outer air passage 12 are separated from the pilot-gas passage 13 by an intermediate wall 17 (FIGS. 2 to 4).

The intermediate wall 17 ends in the direction of flow upstream of the atomization cross section 15 of the airblast nozzle 2. The pilot-gas passage 13 thereby merges directly into the outer air passage 12. The orifice 18 is arranged inside the airblast nozzle 2 and thus substantially closer to the atomization cross section 15 than to the air-inlet opening 19, shown in FIG. 14, of the double-cone burner 1. A jump 20 in cross section of the burner wall 21 is formed at the atomization cross section 15. A spacer 22 is arranged between the burner wall 21 and the intermediate wall 17 of pilot-gas passage 13 and outer air passage 12 and is of wound design (FIG. 2).

During operation with gaseous fuel 6, the pilot gas 9 is already directed through the orifice 18 into the blast air 5. The pilot gas 9 is mixed with blast air 5 thus simultaneously throttles the blast air 5 inflow. The resulting pilot-gas/air mixture 23, directly after entering the inner burner space 16, is mixed with the blast air 5 which has flowed through the inner air passage 11. In the process, the wound design of the spacer 22 results in a swirl of the pilot gas 9 penetrating into the blast air 5. This swirl imparts the desired rotary impulse to the pilot-gas/air relative to the rotating main burner air 7. A plurality of separate swirl generators 24 designed as annular grooves can also be arranged in the pilot-gas passage 13. In this way, a swirl of the pilot gas 9 or of the pilot-gas/air mixture 23 is likewise brought about (FIG. 3).

Figure 3:
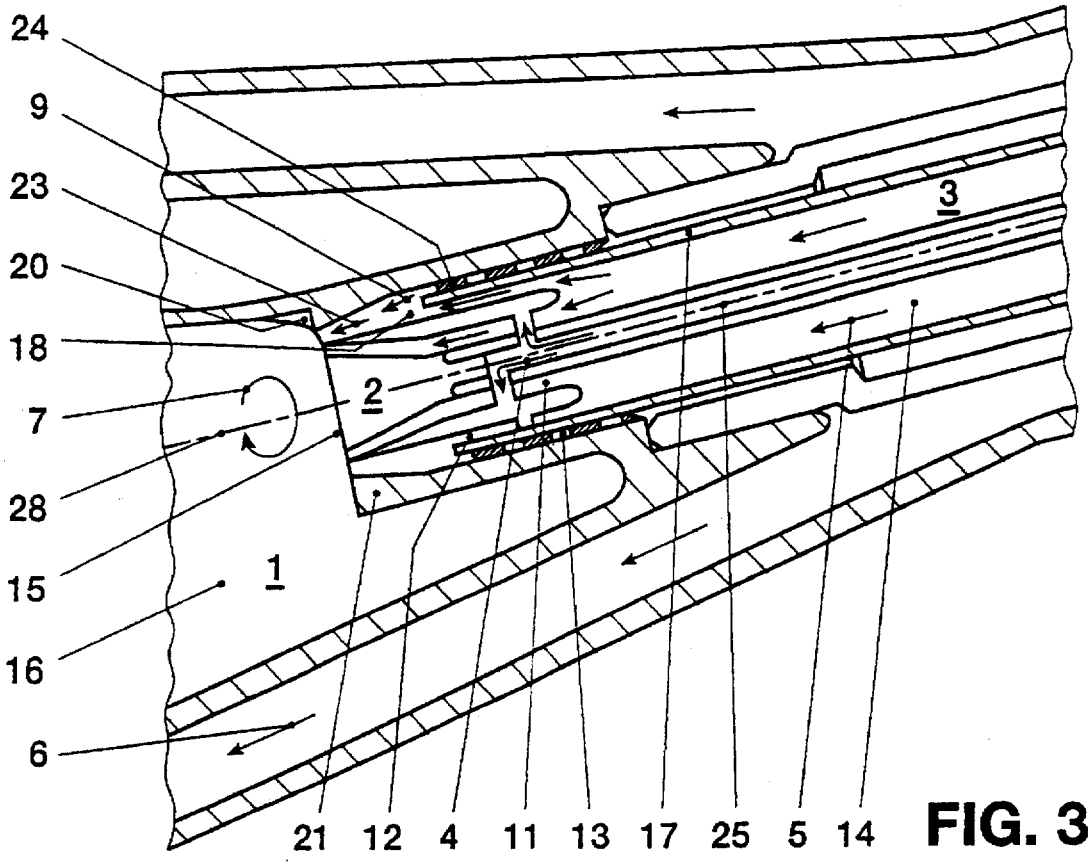
FIG. 3 shows a partial longitudinal section of the burner in another embodiment.
Figure 4:
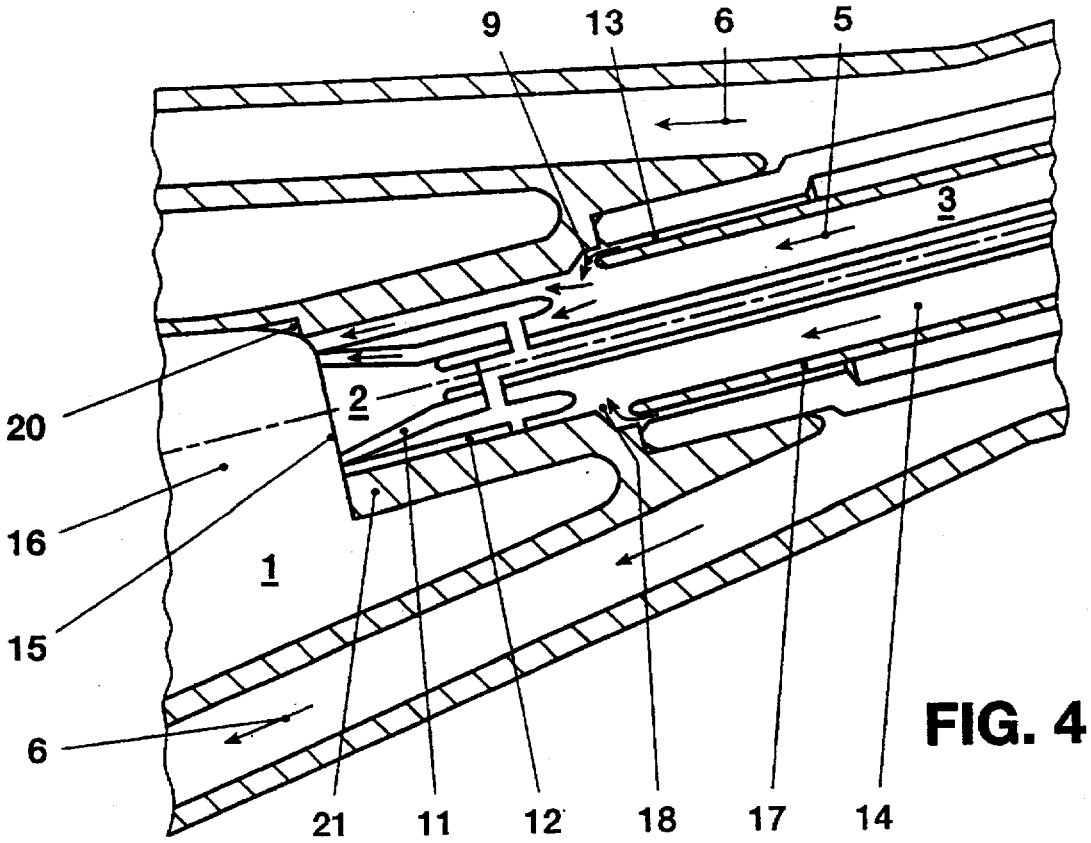
FIG. 4 shows a partial longitudinal section of the burner in a further embodiment.

During operation with liquid fuel 4, this liquid fuel 4 is directed into the airblast nozzle 2 via a fuel-oil line 25 arranged centrally in the fuel lance 3, is finely atomized there by means of the blast air 5 and then passes into the inner burner space 16 for premixing with the main burner air 7 (FIG. 3).

In another exemplary embodiment, the pilot-gas passage 13 ends further upstream in the area in front of the airblast nozzle 2, and the orifice 18 is likewise formed in this area. Thus the blast air 5 is mixed with the pilot gas 9 already before the airblast nozzle 2 (FIG. 4).

Figure 5:
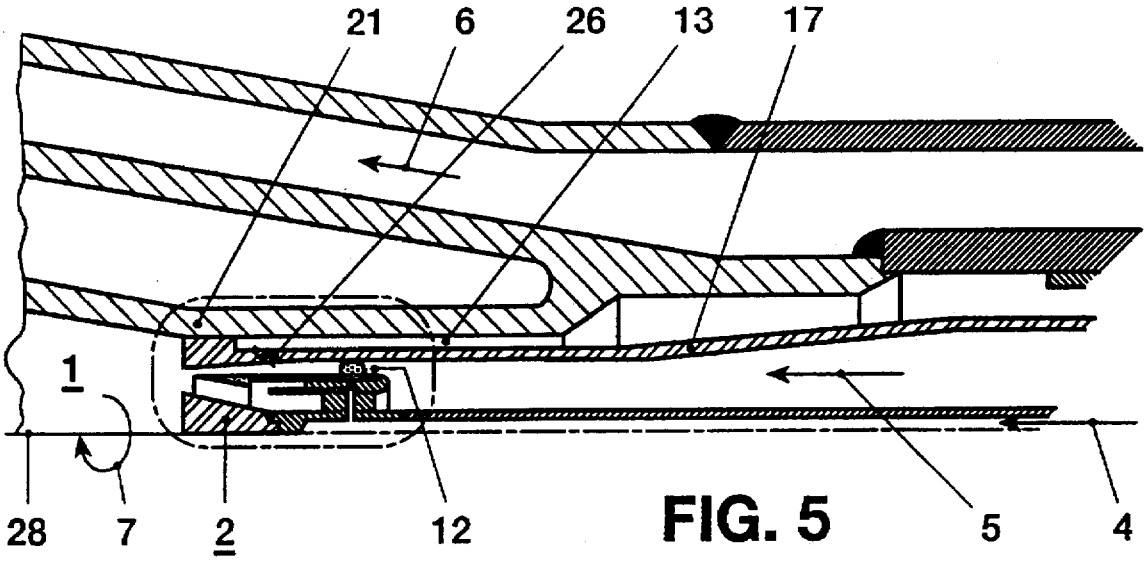
FIG. 5 shows a partial longitudinal section of the burner in a next embodiment.
Figure 6:
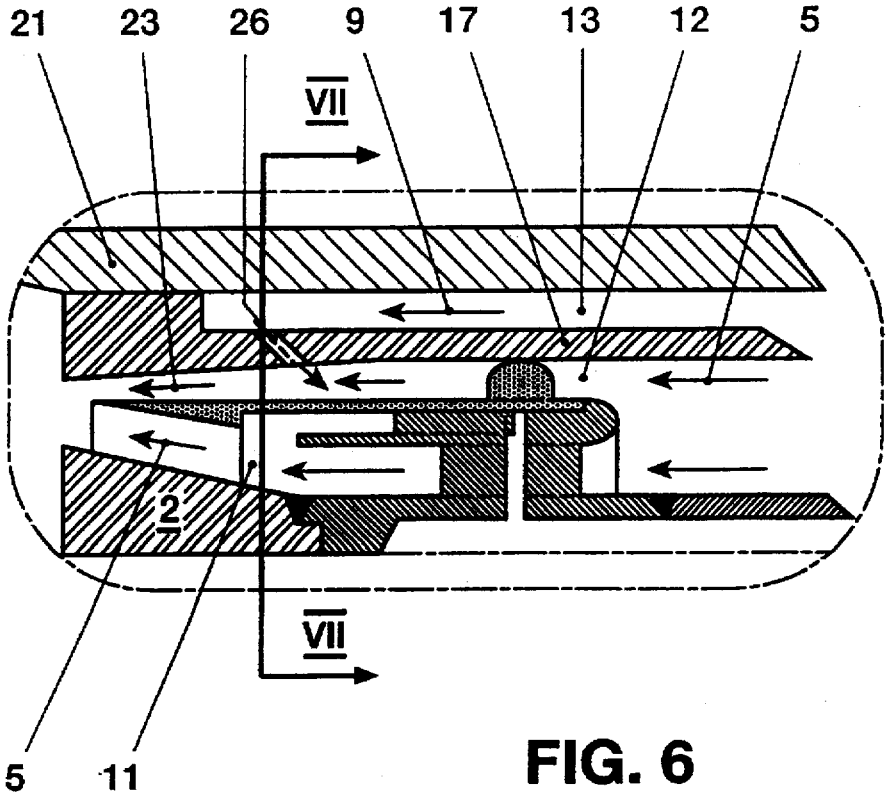
FIG. 6 shows an enlarged detail from FIG. 5.
Figure 7:
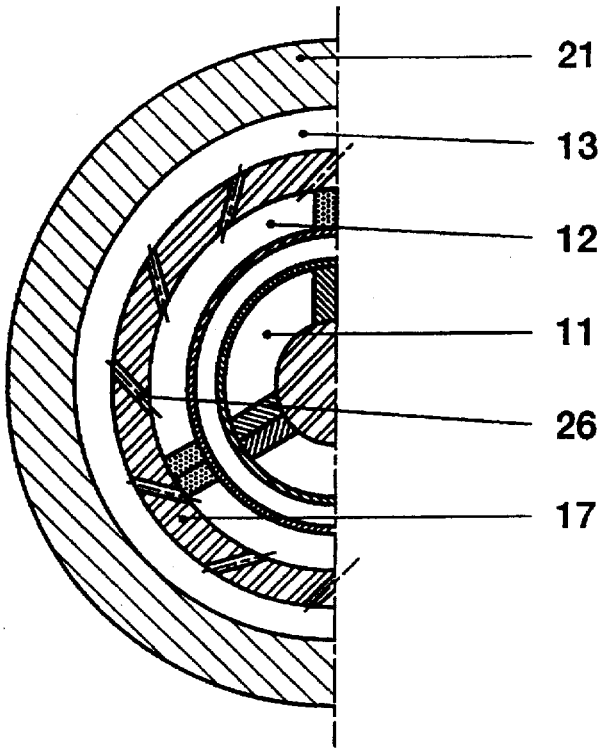
FIG. 7 shows a section VII—VII through the airblast nozzle according to FIG. 6.
Figure 8:
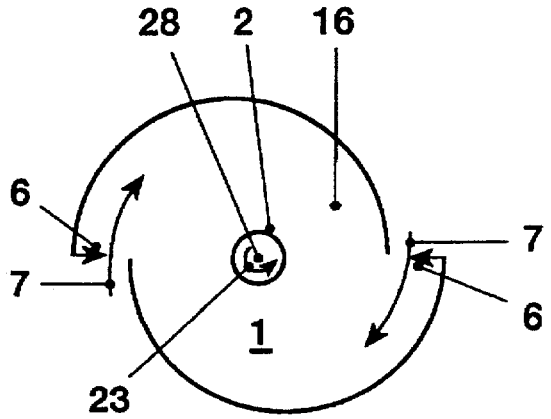
FIG. 8 shows a cross section VIII—VIII through the burner according to FIG. 1, in the configuration according to FIGS. 5 to 7, in simplified representation.

In a further exemplary embodiment, a plurality of uniformly distributed bores 26 are arranged in the intermediate wall 17 of pilot-gas passage 13 and outer air passage 12. They lead tangentially into the outer air passage 12 and are orientated in the opposite direction to both the direction of flow of the blast air 5 and to the direction of rotation of the main burner air 7 of the burner 1 (FIGS. 5 to 7). The blast air 5 is thereby throttled back to an increased extent. In addition, a counter-swirl of the pilot-gas/air mixture 23 and of the main burner air 7 occurs in the inner burner space 16 (FIG. 8). Thus better premixing of the fuel mixture 27 inside the burner 1 is achieved, the axial impulse of the blast air 5 is weakened and the vortex breakdown is displaced into the burner 1 (FIG. 1).

Figure 9:
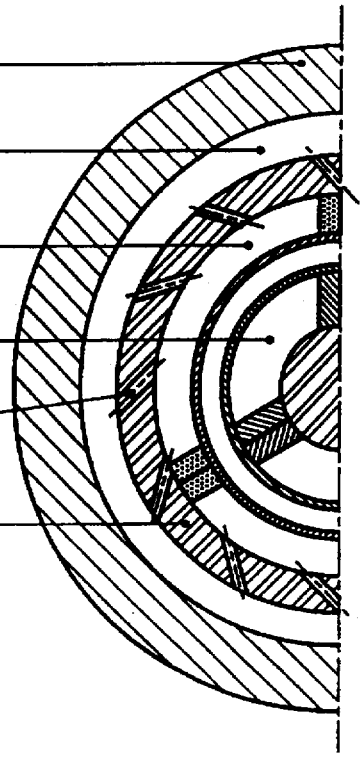
FIG. 9 shows a representation in accordance with FIG. 7 but with bores directed in the opposite direction.
Figure 10:
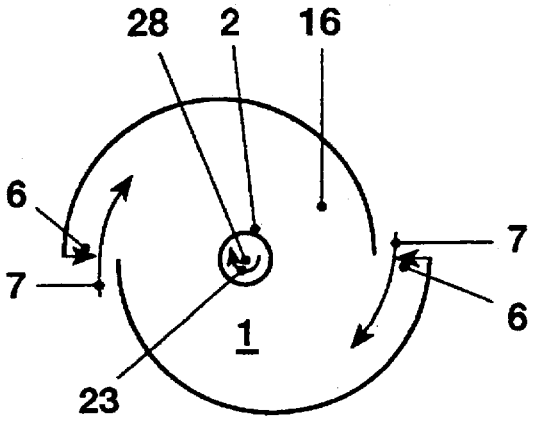
FIG. 10 shows a representation in accordance with FIG. 8 but in the configuration according to FIG. 9.

In a next exemplary embodiment, the bores 26 are likewise orientated against the direction of flow of the blast air 5 but in the direction of rotation of the main burner air 7 (FIG. 9). In this way, a commonly directed swirl of the pilot-gas/air mixture 23 and the main burner air 7 is obtained in the inner burner space 16 (FIG. 10). This commonly directed swirl intensifies the vortex formation in the area of the burner axis 28 and likewise displaces the vortex breakdown into the burner 1. Thus this solution also helps to improve the flame maintenance and thus stabilize the combustion.

Figure 11:
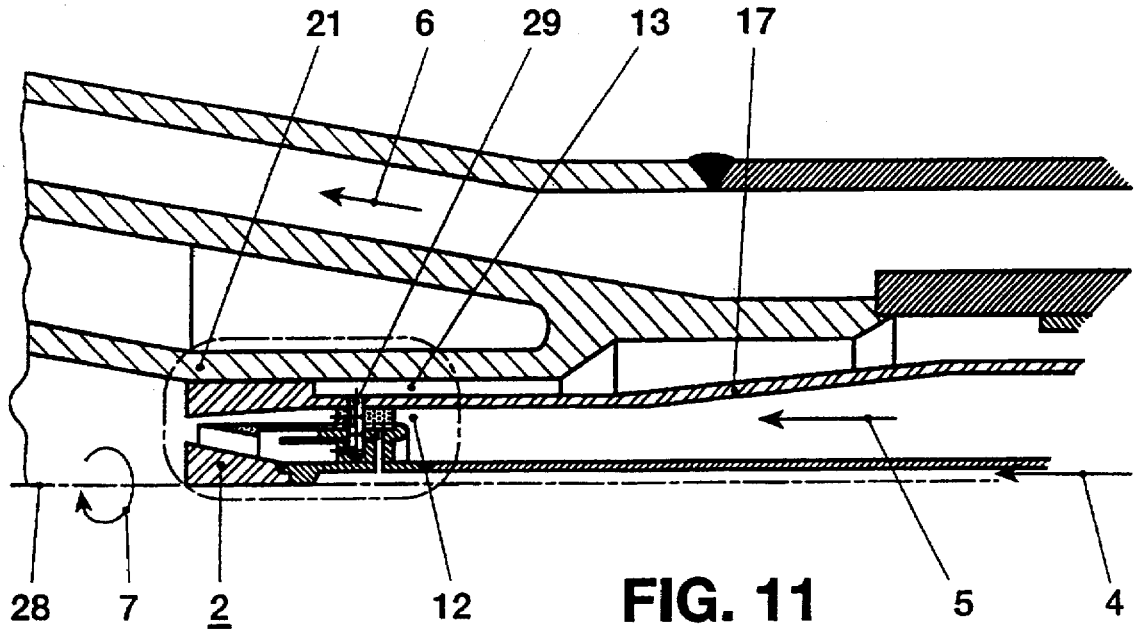
FIG. 11 shows a partial longitudinal section of the burner in a further embodiment.
Figure 12:
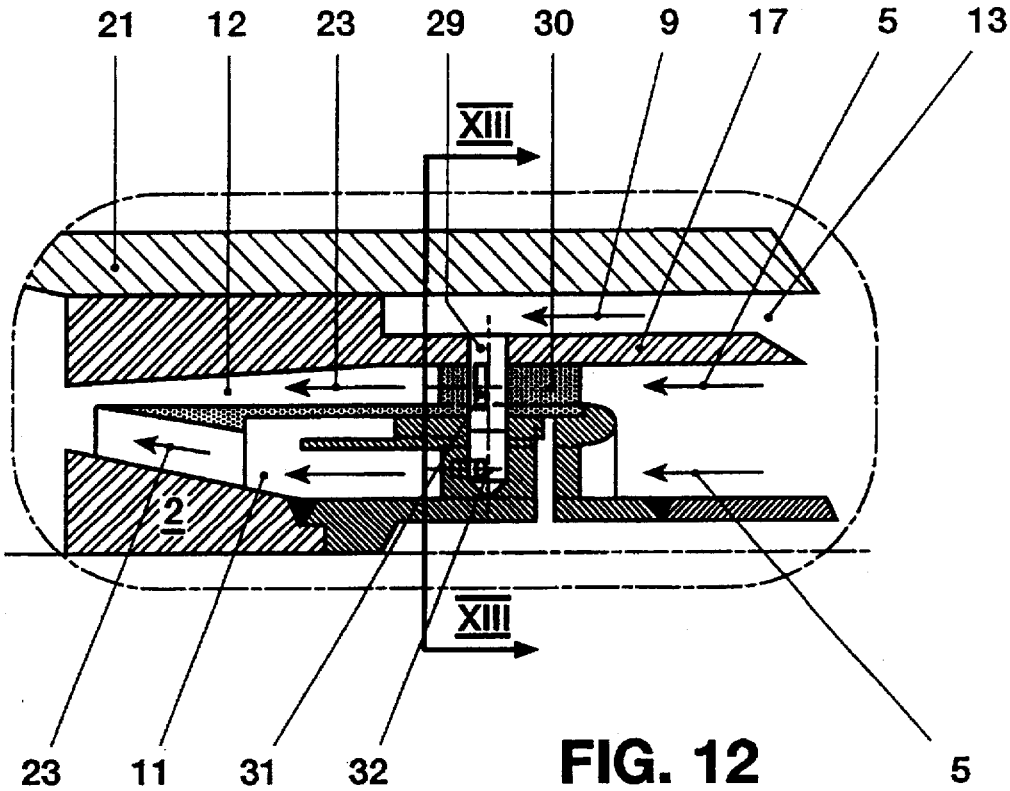
FIG. 12 shows an enlarged detail from FIG.11.
Figure 13:
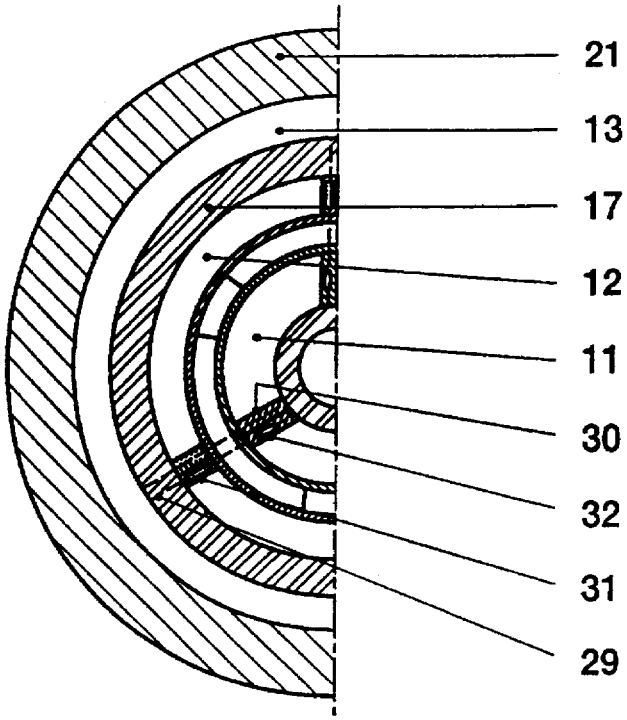
FIG. 13 shows a section XIII—XIII through the airblast nozzle in accordance with FIG. 12.

In a further exemplary embodiment, the pilot-gas passage 13 leads into both air passages 11, 12 inside the airblast nozzle 2. To this end, a plurality of fastening elements 30 provided with one radial blind bore 29 each are arranged on the intermediate wall 17 in the area of the airblast nozzle 2. The blind bores 29 connect the pilot-gas passage 13 to the outer air passage 12 and the inner air passage 11 via a first opening 31 and a second opening 32, respectively. The blast air 5 is thereby throttled back in both air passages 11, 12 (FIGS. 11 to 13).

Figure 14:
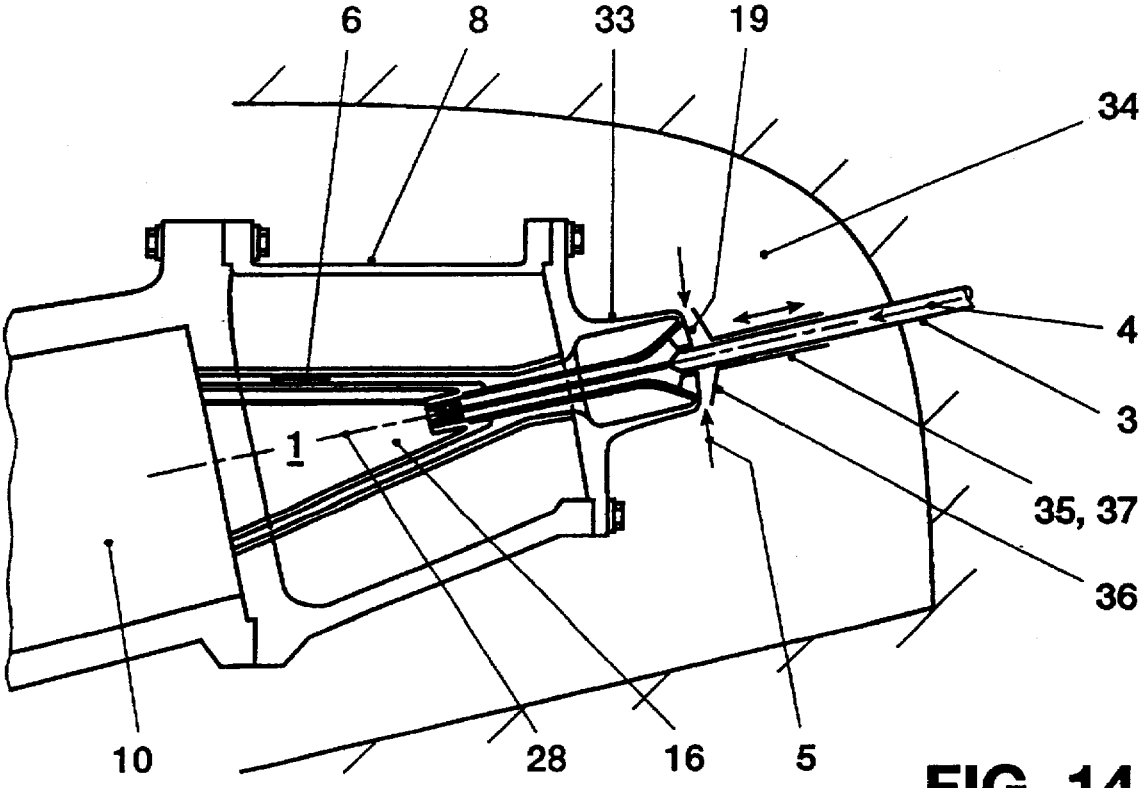
FIG. 14 shows a longitudinal section of the burner in a next embodiment.

In another exemplary embodiment, the double-cone burner 1 is fastened in the burner hood 8 by means of a burner connection piece 33. The air-inlet opening 19 for the blast air 5 flowing in from the plenum 34 is integrated in the burner connection piece 33. To feed the liquid fuel 4, the fuel lance 3 adjoins the burner connection piece 33 upstream. Arranged on the fuel lance 3 is an adjusting mechanism 35 designed as an axially displaceable sleeve 37 provided with a projection 36 (FIG. 14). The adjusting mechanism 35 can also be arranged on the burner connection piece 33. It is controlled by a drive (not shown). By in each case two adjusting mechanisms 35 being connected to one another via a linkage (likewise not shown), the inflow of the blast air 5 into two double-cone burners 1 can advantageously be regulated by means of a common drive. A single drive can of course also be provided for the adjusting mechanisms 35 of all double-cone burners 1 of a gas turbine.

During operation of the double-cone burner 1 with gaseous fuel 6, the sleeve 37 closes the air-inlet opening 19 for the blast air 5 and thus prevents it from flowing into the double-cone burner 1 from the plenum 34. By partial closing of the air-inlet opening 19, it is likewise possible to regulate actively the inflow of the blast air 5 into the inner burner space 16 in accordance with the load state.

However, if only liquid fuel 4 is to be atomized with the blast air 5, the adjusting mechanism 35 is actuated when a fuel pressure of the liquid fuel 4 is applied and thus opens the air-inlet openings 19 of the double-cone burner. The pressure drop in the combustion chamber is utilized as counterpressure to the closing of the air-inlet openings 19.

Figure 15:
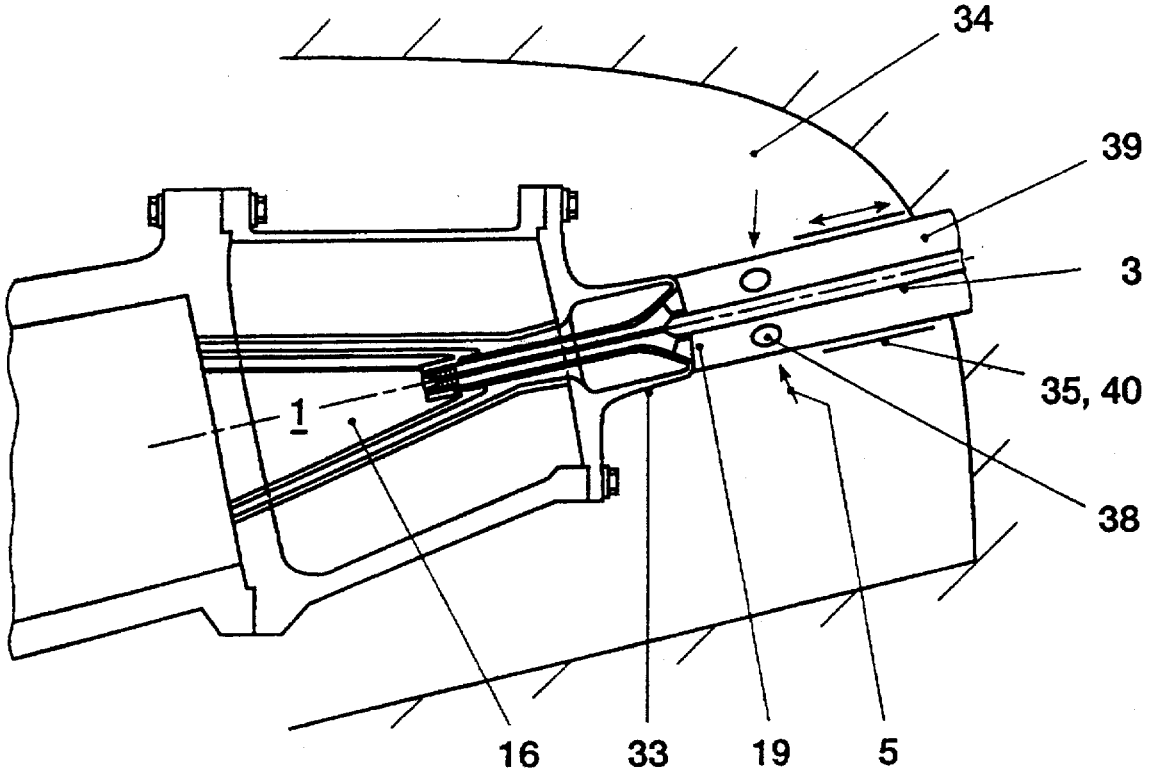
FIG. 15 shows a longitudinal section of the burner in a further embodiment.

In another exemplary embodiment, the adjusting mechanism 35 is arranged on a tube 39 acting on the air-inlet opening 19 of the burner connection piece 33, concentrically enclosing the fuel lance 3 and provided with two radial feed openings 3 for the blast air 5, and is likewise designed as an axially displaceable sleeve 40 (FIG. 15). Here, it is possible by appropriate displacement of the sleeve 40 to throttle back the feed of the blast air 5 completely or partly.

Figure 16:
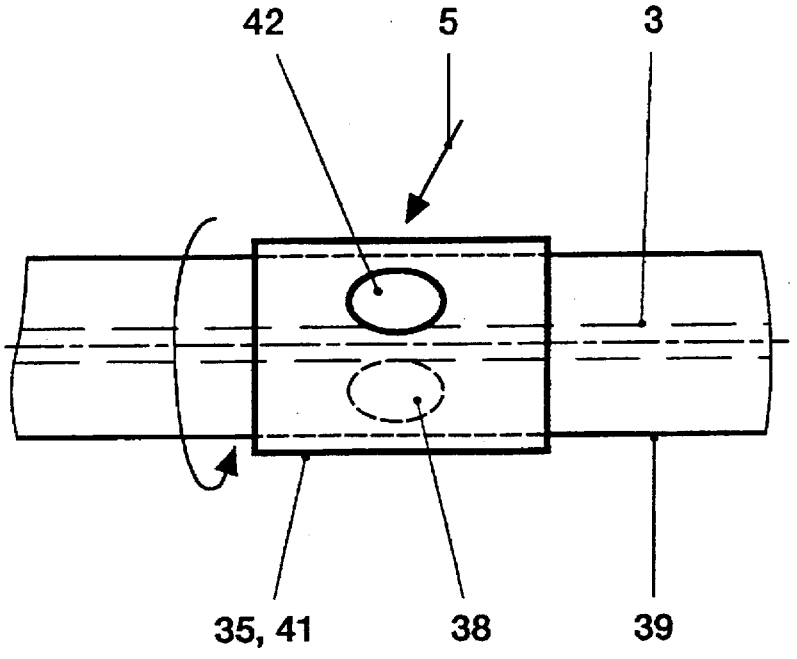
FIG. 16 shows an enlarged detail in accordance with FIG. 15 in a further embodiment.

In a further exemplary embodiment, the adjusting mechanism 35 is designed as rotatably mounted sleeve 41 arranged on the tube 39 concentrically enclosing the fuel lance 3 (FIG. 16). The metering or the complete interruption of the feed of the blast air 5 is realized in this variant of the invention by turning the sleeve 41. To this end, a recess 42 is provided in it, which recess 42 corresponds with the feed opening 38 during operation with liquid fuel 3 but can be closed during operation with gaseous fuel 6.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A method of operating a double-cone burner having an inner burner space for selectable operation with a liquid and a gaseous fuel, the burner including means for introducing a liquid and a gaseous fuel and combustion air into inner burner space, the method comprising the steps of:

for operation with a liquid fuel, directing a flow of liquid fuel to an airblast nozzle for introducing into the inner burner space;

directing, blast air fed from a plenum from outside a burner hood to the airblast nozzle coaxially and in inward and outward streams about an outlet for the fuel to atomize the liquid fuel, and for operation with a gaseous fuel, directing a main gaseous flow into the inner burner space, and providing a pilot gas flow about said outward air blast stream and discharging said pilot gas into said outward air blast prior to discharging the pilot gas and outward air blast from said air blast nozzle into said inner burner space for controlling the inflow rate of the blast air into the inner burner space.

2. The method as claimed in claim 1, wherein, for operation with gaseous fuel, the method further comprises the step of at least partly throttling back the inflow rate of the blast air into the inner burner space.

3. The method as claimed in claim 2, wherein the the step of throttling-back the blast air is effected by displacing a portion of the blast air flow with pilot gas.

4. The method as claimed in claim 3, wherein the pilot gas is directed non-axially into the flow of blast air.

5. The method as claimed in claim 1, wherein for operation with gaseous fuel the method further comprises the step of swirling the pilot gas and at least partly throttling back the inflow rate of the blast air into the inner burner space.

6. The method as claimed in claim 5, wherein the pilot gas is directed into the outer air passage with a flow direction against a direction of flow of the blast air.

7. The method as claimed in claim 6, wherein the burner has a main flow having a rotation, and wherein the pilot gas is introduced into the outer air passage tangentially to and against a direction of rotation of the main burner air flow.

8. The method as claimed in claim 6, wherein the burner produces a main air flow having a rotation and wherein the pilot gas is introduced into the outer air passage tangentially to and in the direction of rotation of the main burner air flow.

9. The method as claimed in claim 1, further comprising the step of regulating the inflow rate of the blast air to the inlet of the burner.

10. The method as claimed in claim 9, wherein the the step of regulating the blast air is effected at least during changes between operation with liquid fuel and operation with gaseous fuel.

11. The method as claimed in claim 9, further comprising the step of initiating the inflow of blast air responsive to a fuel pressure of the liquid fuel, and wherein a pressure drop in the combustion chamber is utilized as counterpressure for stopping the inflow of blasting air.

12. The method as claimed in claim 9, wherein the step of regulating the blast air is effected independently of a state of operation of the burner with one of gaseous and liquid fuel.

13. A double cone type burner for selectable operation with a liquid fuel and a gaseous fuel, comprising:

a burner wall including two half-conical shells defining an inner burner space with an inlet end, an airblast nozzle having an outlet at the inlet end of the burner space, the outlet defining an atomization cross section, means forming annular inner and outer air passages connected to feed blast air to the airblast nozzle, means for feeding a liquid fuel to the air blast nozzle between said inner and outer air passages, means for feeding a gaseous fuel to the burner, an air-feed line connected to feed the inner and outer air passages with blast air, and means forming a pilot-gas passage arranged annularly outward of the air passages, wherein the air passages open into the inner burner space at the atomization cross section of the airblast nozzle, the means forming the air passages including an inner intermediate wall separating one air passage from another and the outer air passage and pilot-gas passage including a common outer intermediate wall ends upstream of the atomization cross section of the airblast nozzle in the direction of flow, so that gas from the pilot-gas passage mixes with air from the outer air passage upstream of the air blast nozzle outlet.

14. The device as claimed in claim 13, further comprising at least one spacer disposed between the burner wall and the outer intermediate wall, the spacer having a wound design for producing a swirl in the pilot gas flow.

15. The device as claimed in claim 13, comprising a plurality of individual swirl generators arranged in the pilot-gas passage.

16. The device as claimed in claim 13, wherein the burner wall is formed with a radially outwardly extending jump at an outlet of the airblast nozzle communicating with the inner burner space.

17. The burner as claimed in claim 13, wherein the burner is fastened in a burner hood by a burner connection piece having an integrated air-inlet opening for the blast air, and a fuel lance is joined to the burner connection piece for feeding the liquid fuel to the burner, wherein an adjusting mechanism is arranged on one of the fuel lance and the burner connection piece for controlling the air-inlet opening for the blast air during operation of the burner with gaseous fuel.

18. The device as claimed in claim 17, wherein the adjusting mechanism is an axially displaceable sleeve enclosing the fuel lance and provided with a projection for selectively covering the air-inlet opening.

19. The device as claimed in claim 17, wherein the adjusting mechanism comprises a tube enclosing the air-inlet opening of the burner connection piece and concentrically enclosing the fuel lance, the tube having at least one radial feed opening for the blast air and means for controlling the at least one radial feed opening.

20. The device as claimed in claim 19, wherein the means for controlling the at least one radial feed opening of the adjusting mechanism includes one of an axially displaceable sleeve and a rotatably mounted sleeve.

21. The device as claimed in clam 20, wherein the controlling means is a rotatably mounted sleeve having at least one recess corresponding to the at least one the feed opening for the blast air.

* * * * *